US006184767B1

(12) United States Patent
Pischinger et al.

(10) Patent No.: US 6,184,767 B1
(45) Date of Patent: Feb. 6, 2001

(54) ELECTROMAGNETIC ACTUATOR HAVING A JOINT-SUPPORTED RESETTING SPRING

(75) Inventors: Martin Pischinger; Thomas Esch, both of Aachen; Markus Duesmann, Stolberg, all of (DE)

(73) Assignee: FEV Motorentechnik GmbH, Aachen (DE)

( * ) Notice: Under 35 U.S.C. 154(b), the term of this patent shall be extended for 0 days.

(21) Appl. No.: 09/311,305

(22) Filed: May 14, 1999

(30) Foreign Application Priority Data

May 22, 1998 (DE) ..... 198 22 907

(51) Int. Cl.[7] ..... H01F 3/00

(52) U.S. Cl. ..... 335/256; 123/90.11; 251/129.16; 335/251

(58) Field of Search ..... 335/220, 251, 335/257; 123/90.11; 251/129.01, 129.02, 129.1, 129.15, 129.16

(56) References Cited

U.S. PATENT DOCUMENTS

| | | | | |
|---|---|---|---|---|
| 3,813,625 | * | 5/1974 | Kinsella | 335/263 |
| 5,813,653 | * | 9/1998 | Esch et al. | 251/129.1 |
| 5,868,108 | * | 2/1999 | Schmitz et al. | 123/90.11 |
| 5,878,704 | * | 3/1999 | Schebitz et al. | 123/90.11 |

* cited by examiner

*Primary Examiner*—Lincoln Donovan
*Assistant Examiner*—Tuyen T. Nguyen
(74) *Attorney, Agent, or Firm*—Venable; Gabor J. Kelemen

(57) ABSTRACT

An electromagnetic actuator includes an electromagnet; and an armature movable toward the electromagnet by an electromagnetic force generated upon energization of the electromagnet. The armature is connectable to a setting member displaced as a function of armature motions. The electromagnetic actuator further has a resetting spring which opposes the electromagnetic force and which has a first end supported in a housing and a second end; and at least one jointed connecting arrangement interposed between the resetting spring and the armature for supporting the armature on the second end of the resetting spring.

8 Claims, 1 Drawing Sheet

ELECTROMAGNETIC ACTUATOR HAVING A JOINT-SUPPORTED RESETTING SPRING

CROSS REFERENCE TO RELATED APPLICATION

This application claims the priority of German Application No. 198 22 907.0 filed May 22, 1998, which is incorporated herein by reference.

BACKGROUND OF THE INVENTION

An electromagnetic actuator for operating a setting member (for example, a cylinder valve of art internal-combustion engine) has at least one electromagnet—but frequently two spaced electromagnets—energizable in a controlled manner. The electromagnet is associated with an armature which is connected with a guide rod and which is further operatively connected with the setting member. Upon energization of the electromagnet the armature is moved into an end position against the force of a resetting spring and the armature again assumes its initial position when the electromagnet is de-energized. In case two electromagnets and thus two resetting springs are used, during alternating energization of the electromagnets, the armature is reciprocated in accordance with the frequency of the alternating energization. The duration of the energization of an electromagnet also determines the period in which the armature is held at the pole face of the respective attracting electromagnet and, accordingly, the setting member which is operated by the armature is held in the respective switching position.

An electromagnetic actuator of the above-outlined type having two electromagnets is used in particular for operating a cylinder valve of an internal-combustion engine. In such a construction the resetting springs, serve as respective opening and closing springs for the cylinder valve. Because of the necessarily large forces required to maintain the cylinder valve in its closed position and, also, to open the cylinder valve against the gas pressure within the engine cylinder, strong compression coil springs are required which are loaded (compressed) parallel to their geometrical central axis. Such an axis, at the same time, represents the line of motion of the armature, and if the setting member is a cylinder valve, such an axis also represents the line of motion of the cylinder valve.

The end faces of a compression coil spring of the above-outlined type have a planar annular configuration to ensure a satisfactory seating of the spring on the associated spring support.

Because of manufacturing tolerances, however, the effective operating path line of the resulting force of the compressed coil springs generally does not coincide with the geometric central axis. As a result, the Force is not evenly distributed over the spring seating surface, but is introduced at a location preferred by the structure. An eccentric location of the point of force introduction causes, in the seating surface of the compression spring, reaction forces which may be demonstrated by the existence of transverse forces and tilting torques. Such torques are transmitted from the spring support to the armature and the armature guide rod and cause, in addition to a rotation of the armature about its axis of motion, a rocking (tilting) motion of the armature transversely to the Line of motion. As an undesired result, the armature strikes the components laterally bordering the armature chamber, and also, stochastic frictional effects are introduced. A rotation of the armature about its longitudinal axis is particularly disadvantageous in actuator constructions in which the armature is not of rotationally symmetrical configuration but is, for example of rectangular outline. Because of such a tilting motion and as a function of the location of force introduction, the release behavior of the armature from the pole face changes as the electromagnet is de-energized.

SUMMARY OF THE INVENTION

It is an object of the invention to provide an improved electromagnetic actuator of the above-outlined type from which the discussed disadvantages are eliminated.

This object and others to become apparent as the specification progresses, are accomplished by the invention, according to which, briefly stated, the electromagnetic actuator includes an electromagnet and an armature movable toward the electromagnet by an electromagnetic force generated upon energization of the electromagnet. The armature is connectable to a setting member displaced as a function of armature motions. The electromagnetic actuator further has a resetting spring which opposes the electromagnetic force and which has a first end supported in a housing and a second end; and at least one jointed connecting arrangement interposed between the resetting spring and the armature for supporting the armature on the second end of the resetting spring.

The armature which is usually connected with a spring seat disk of the armature guide rod and to which thus the resetting forces of the spring are applied, is, by virtue of the interpositioned jointed structure, disconnected from the resetting spring so that rotational motions appearing during the loading and relaxing of the compression coil spring are transmitted to the armature to a negligible extent—if at all—due to the frictional forces in the region of the joint. Geometrical deviations of the effective path of the resulting spring force relative to the geometric central axis of the spring can no longer act as a tilting force on the armature via the armature guide rod. The joint is to be designed such that it has at least two degrees of freedom. In both earlier-noted uses in which the joint has three degrees of freedom, the joint permits a motion of the resetting spring relative to the armature in all three coordinates, that is, in addition to a tilting motion relative to the central axis, it also permits a rotation about the axis without force transmission. Expediently, the joint is formed by a spherical joint which is preferably free from transverse forces.

According to an advantageous feature of the invention, the resetting spring is a compression coil spring and the center of the joint lies on the geometrical center line of the spring.

According to a further feature of the invention, the resetting spring is supported on the housing by a spherical joint arrangement. Such an arrangement further minimizes interfering effects of the resetting spring on the armature because both spring ends, by virtue of the given degrees of freedom of the joint, may freely move relative to the armature and/or the housing.

According to a further advantageous feature of the invention, the joint includes a supporting yoke for the resetting spring. Such a supporting yoke may be a plate or a transverse member which, on the one side, constitutes the seating surface for the resetting spring and, on the other side, constitutes a part of the spherical joint. In such a construction it is feasible to provide the supporting yoke with a bore into which a suitably dimensioned steel ball is pressed and which cooperates with a corresponding counterface of the housing and/or the armature guide rod. The arrangement may further be such that the supporting yoke is either planar or is provided with cup-shaped depressions which are engaged by the spherical counter element or the correspondingly configured spherical end of the armature guide rod.

BRIEF DESCRIPTION OF THE DRAWING

The sole FIGURE is a schematic axial sectional view of a preferred embodiment of the invention.

DESCRIPTION OF THE PREFERRED EMBODIMENT

Figure 1:
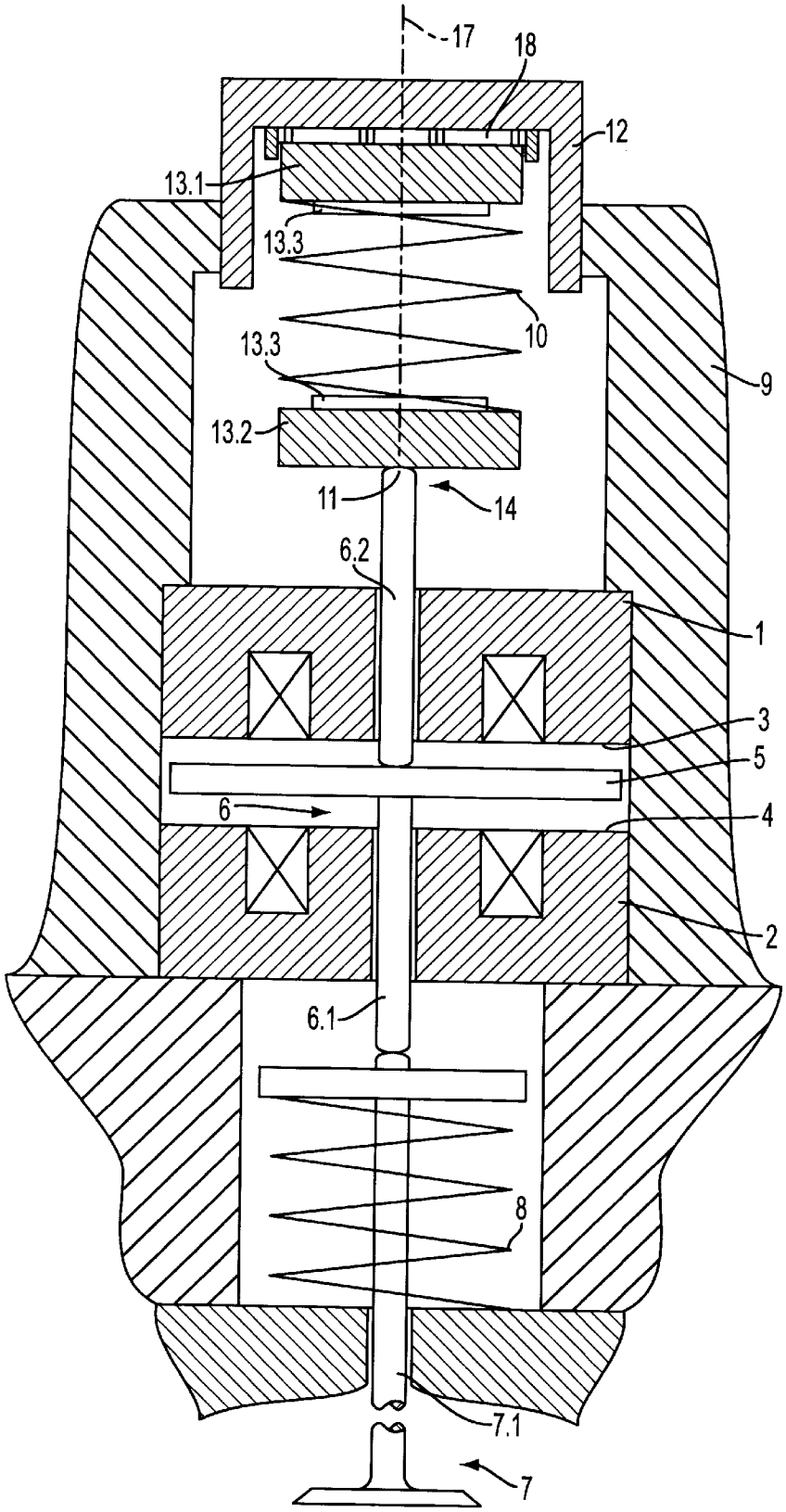

The electric actuator shown in the FIGURE is composed essentially of a closing magnet 1 and an opening magnet 2, whose respective pole faces 3 and 4 are oriented towards one another. Between the two pole faces 3 and 4 an armature 5 is arranged which is connected with a guide rod 6, composed of guide rod parts 6.1 and 6.2. The guide rod part 6.1 which is affixed to the armature 5, has a free outer end which is in a contacting relationship with the stem 7.1 of a cylinder valve 7, constituting a setting member. A valve closing spring 8 surrounding the valve stem 7.1 urges the cylinder valve 7 into its closed position and forms, at the same time, a resetting spring for the electromagnetic actuator. The guide rod part 6.2 operates as a plunger and is only force-transmittingly coupled to that face of the armature 5 which is oriented away from the guide rod part 6.1. The guide rod part 6.1 has a convex end and is in engagement with the convex end of the valve stem 7.1. Because of the substantially point contact between the components 6.1 and 7.1, rotational motions of the closing spring 8 are not transmitted to the guide rod part 6.1. The cylinder valve 7 may, in contrast, execute the desired rotational motions.

In-a housing 9 at the upper end of the electromagnetic actuator a resetting spring 10 is arranged which operates as a valve opening spring and which engages the free end 11 of the guide rod part 6.1 and which, at its other, upper end is supported by a height-adjustable setting cap 12 closing off the housing 9. By adjusting the axial position of the cap 12 relative to the housing 9 the spring bias of the opening spring 10 and/or the mid position of the armature 5 between the two electromagnets 1 and 2 may be set.

The closing spring 8 and the opening spring 10 are so designed that in the de-energized state of the electromagnets 1 and 2 the armature 5 assumes its illustrated mid position between the two pole faces 3 and 4. When the closing magnet 1 is energized, the armature 5 is brought to rest at the pole face 3 against the force of the opening spring 10. If thereafter the closing magnet 1 is de-energized and the opening magnet 2 is energized, the armature 5, together with the cylinder valve 7 is, by virtue of the bias of the opening spring 10, displaced in the opening direction and as the armature 5 passes its mid position, the electromagnetic force of the opening magnet 2 captures the armature 5 and brings it into engagement with the pole face 4. The closing of the cylinder valve 7 occurs in the reverse order.

The valve stem 7.1 and the closing spring 8 are separated from the guide rod part 6.1 of the armature 5; the components 7.1 and 6.1 are essentially in a point-contact with one another. A separation of the two components 7.1 and 6.1 is expedient at least for the reason to permit a replacement of the electromagnetic actuator without the need to release the closing spring 8.

In the embodiment illustrated, the opening spring 10 is provided at its ends with an upper and a lower support yoke 13.1 and 13.2, respectively. That surface of the respective support yoke 13.1 and 13.2 which is oriented towards the opening spring 10 has a centering elevation 13.3 and forms a spring supporting surface. If expedient, the support yokes 13.1 and 13.2 may be fixedly connected with the associated end of the opening spring 10 so that the latter forms a structural unit together with the two support yokes 13.1 and 13.2.

That surface of at least one of the supporting yokes 13.1 and 13.2 which is oriented away from the spring 10 is configured as a joint 14. For this purpose, the lower surface of the supporting yoke 13.2 is shown in the FIGURE to be planar, and is engaged by the convex terminus of the guide rod part 6.2. In this manner a spherical joint is obtained which is free from transverse forces. As a variant, the yoke surface oriented towards the guide rod part 6.2 may be provided with a spherical recess which is contacted by a complemental counterface on the guide rod part 6.2. In such an arrangement the centering member 13.3 is omitted so that the closing spring 10 may move transversely on the support yoke 13.2 and may"find" its own line of motion.

The supporting yoke 13.1 too, may be jointedly coupled to the cap 12 according to the invention. For this purpose, a pin may be disposed within the cap 12 to cooperate with a corresponding curved upper surface of the supporting yoke 13.1. As a variant, the joint arrangement may be reversed, that is, the projecting part may be arranged on the supporting yoke 13.1 whereas the depression may be provided in the cap 12.

In both joint arrangements the center of the joint lies on the geometrical center line 17 of the opening spring 10. Such a jointed support of the spring unit formed of the compression coil spring 10 and the support yokes 13.1 and 13.2 ensures that no forces can be transmitted to the guide rod part 6.2 which would act as bending torques. By means of a suitable lubrication, for example, an oil mist lubrication or the like, the friction and wear of the joint arrangements may be minimized.

To substantially eliminate the effect of rotational forces on the armature 5, generated about She line of motion during compression and release of the opening spring 10, it is expedient to arrange an axial bearing in the region of one of the support yokes 13.1 and 13.2. As shown in the FIGURE, that end of the supporting yoke 13.1 which is oriented toward the cap 12 is supported on the cap 12 by an axial bearing 18, for example, a needle bearing. Such an arrangement on the housing-side supporting yoke 13.1 has the advantage that the moving mass is not increased. The supporting yoke 13.2 is expediently so designed that while preserving its required strength, it has the smallest possible mass. This may be achieved, for example, by using high-strength materials.

As a further modification, the supporting yoke 13.1 is a divided structure, and the axial bearing 13 is disposed between the two parts. In such a construction the supporting yoke 13.1 may be supported on the inner face of the cap 12 by a joint arrangement of the type described above.

It will be understood that the above description of the present invention is susceptible to various modifications, changes and adaptations, and the same are intended to be comprehended within the meaning and range of equivalents of the appended claims.

What is claimed is:

1. An electromagnetic actuator comprising:

(a) a first electromagnet having a first pole face;

(b) a second electromagnet having a second pole face;

(c) means for supporting said first and second electromagnets; said first and second pole faces being oriented toward one another and defining a space therebetween;

(d) an armature movably disposed in said space for executing a reciprocating motion between said first and second pole faces urged by electromagnetic forces produced upon energization of said first and second electromagnets;

(e) first and second springs;

(f) means for supporting and positioning said first and second springs to oppose motions of said armature caused by electromagnetic forces; and (g) a guide rod having (1) a first guide rod part firmly secured to said armature;

(2) a second guide rod part being a component separate from, and unsecured to, said armature;

(h) jointed connecting means for supporting said second guide rod part on said first spring; said first spring being arranged to urge, through said jointed connecting means, said second guide rod part into contact with said armature.

2. The electromagnetic actuator as defined in claim 1, wherein said resetting spring is a compression coil spring having a central longitudinal geometrical axis; said jointed connecting means having a joint center lying on said axis.

3. The electromagnetic actuator as defined in claim 1, wherein said jointed connecting means includes at least one yoke for supporting said first spring.

4. The electromagnetic actuator as defined in claim 1, wherein said jointed connecting means includes at least one yoke affixed to said resetting spring.

5. The electromagnetic actuator as defined in claim 1, wherein said jointed connecting means comprises:

(a) a yoke having a first face being in engagement with said first spring and a second face oriented toward said second guide rod part; and (b) a convex end forming part of said second guide rod part and contacting said second face.

6. The electromagnetic actuator as defined in claim 1, wherein said jointed connecting means includes means for substantially preventing any force from being transmitted between said first spring and said second guide rod part in any direction transverse to a direction of said reciprocating motion.

7. The electromagnetic actuator as defined in claim 1, further comprising:

(a) a housing accommodating said first spring;

(b) a cap held in said housing and at least indirectly supporting said first spring; and (c) torque-preventing means for preventing a torque from being transmitted from said second guide rod part to said armature.

8. The electromagnetic actuator as defined in claim 7, when said torque-preventing means includes an axial bearing positioned at a location between said cap and said armature.

* * * * *